United States Patent [19]

Rossmann

[11] Patent Number: 4,512,719

[45] Date of Patent: Apr. 23, 1985

[54] HOT GAS WETTED TURBINE BLADE

[75] Inventor: Axel Rossmann, Karlsfeld, Fed. Rep. of Germany

[73] Assignee: Motoren-un Turbinen-Union Munchen GmbH, Munich, Fed. Rep. of Germany

[21] Appl. No.: 396,344

[22] Filed: Jul. 8, 1982

[30] Foreign Application Priority Data

Jul. 24, 1981 [DE] Fed. Rep. of Germany ..... 3129304

[51] Int. Cl.[3] ..... F01D 5/18

[52] U.S. Cl. ..... 416/241 B

[58] Field of Search ..... 416/241 B, 225, 230; 415/214

[56] References Cited

U.S. PATENT DOCUMENTS

| | | | |
|---|---|---|---|
| 2,431,660 | 11/1947 | Gaudenzi | 416/241 B |
| 2,479,057 | 8/1949 | Bodger | 416/241 B UX |
| 3,215,511 | 11/1965 | Chisholm et al. | 416/241 B UX |
| 3,304,056 | 2/1967 | Sohma | 415/214 X |
| 3,315,941 | 4/1967 | Davies | 416/241 B UX |
| 4,247,259 | 1/1981 | Saboe et al. | 416/241 B |
| 4,285,634 | 8/1981 | Rossmann et al. | 416/241 B X |
| 4,314,794 | 2/1982 | Holden et al. | 416/225 X |
| 4,349,203 | 9/1982 | Schülke | 416/241 B X |

FOREIGN PATENT DOCUMENTS

| | | | |
|---|---|---|---|
| 380391 | 5/1940 | Italy | 416/241 B |
| 572059 | 9/1945 | United Kingdom | 415/214 |

*Primary Examiner*—Robert E. Garrett
*Assistant Examiner*—Joseph M. Pitko
*Attorney, Agent, or Firm*—Posnack, Roberts, Cohen & Spiecens

[57] ABSTRACT

A turbine blade adapted for use with hot gases comprising a radially inward portion of metal including a core projecting radially outwards on which is supported a ceramic portion of airfoil section enclosing the core. The inner end of the ceramic portion forms a continuous surface contour with the metal inward portion. The ceramic portion extends no more than one-half of the total span of the blade and, preferably, about one-third of the blade span. In a particular embodiment, the wall thickness of the ceramic portion can increase in an radially outwards direction.

5 Claims, 2 Drawing Figures

HOT GAS WETTED TURBINE BLADE

FIELD OF THE INVENTION

This invention relates to a turbine blade which is adapted for being wetted with a hot gas and which includes metal and ceramic blade portions.

PRIOR ART

German Patent Specification No. 736,958 discloses a gas turbine blade having a supporting body of steel and a sleeve of ceramic material, the ceramic sleeve extending over the entire blade span and being retained at its outer end by means of a retaining plate arranged at the head end of the supporting body. Similar composite metal and ceramic blades have been disclosed in German Pat. No. 848,883 and U.S. Pat. No. 2,479,057.

It has been found that blades of this type can develop cracks in the ceramic sleeve especially when used as rotor blades in high-speed rotors. Such cracks, which lead to subsequent destruction, are attributed to substantial compressive stresses arising in the ceramic airfoil at high speeds, where said stresses exceed the safe surface compression limits. The fracture of ceramic sleeves, when occurring in service, produces considerable consequential damage to the turbines. Another problem in the known turbine blades is satisfactory retention of the ceramic sleeve in the head region of the metal supporting core. The longer the ceramic sleeve, the greater the resulting centrifugal forces, and the more reliable the retention means at the head of the supporting core must be, which requirement often is not sufficiently satisfied for reasons of space limitations.

SUMMARY OF THE INVENTION

An object of the present invention is to provide a turbine blade including metal and ceramic portions which has high durability for a considerable blade span and high centrifugal loads without sacrificing ceramic airfoils known for their resistance to high temperature and erosion.

In accordance with the above and further objects of the invention, there is provided a turbine blade adapted for use with hot gases comprising a radially inward portion constituted of metal including a metal core projecting radially from the inward portion on which a ceramic portion of airfoil section is supported to enclose the metal core.

In this way, the outer portion of the blade is constituted of ceramic material and the ceramic portion extends radially less than one-half of the total span of the blade and, perferably, about one-third of the blade span.

The reduction in the length of the ceramic airfoil achieved by the present invention correspondingly reduces the ceramic mass and, thus, the centrifugal forces imposed thereon. This alleviates surface pressures in the area of contact between the ceramic airfoil and the supporting core, and it reduces the load on the supporting core. The reduction in ceramic airfoil compression considerably reduces the risk of cracking and subsequent fracture thereof.

In other respects, the construction in which metal is used for the radially inward portion of the blade is acceptable for most applications, since all particulate matter in the gas stream will be found in the radially outer region of the gas stream, and it is only there that the high resistance to erosion afforded by the ceramic material is truly indispensable.

A blade construction in accordance with the present invention will give improved operational reliability to turbomachines also in the case of blade fracture, because the small size of the broken component, i.e. the ceramic airfoil, will limit the consequential damage inflicted on adjacent, especially downstream components. Since a portion of the turbine blade is of metal, e.g. steel, some degree of serviceability will still be retained even in the event that the ceramic airfoil has been destroyed. This will prevent a complete and immediate loss of turbine power.

According to another advantageous aspect of the present invention, the length of the radially outward, ceramic airfoil occupies no more than one-half of the full blade span, and, in a preferred arrangement, the ceramic airfoil occupies about one-third of the blade span.

For reasons of good design, the supporting core has, as in a previously disclosed arrangement, a mushroom-shaped head at its radially outward end for support of the ceramic airfoil.

DETAILED DESCRIPTION

Figure 1:
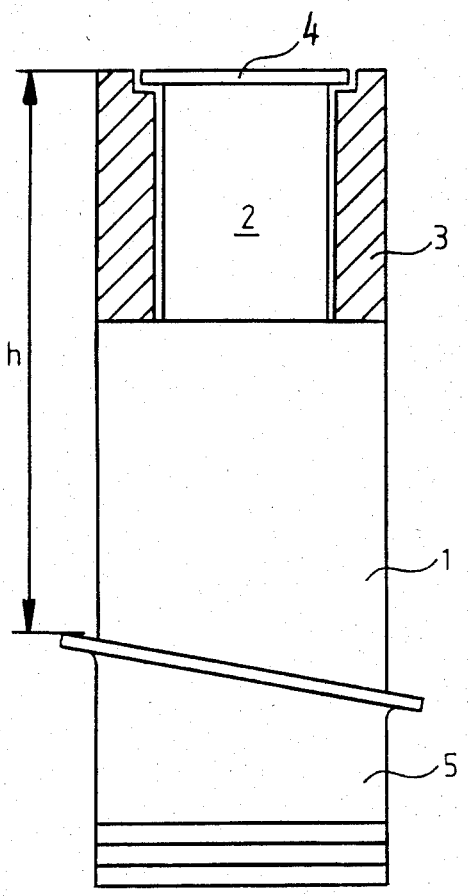
FIG. 1 is a fragmentary sectional view of a first embodiment of the invention.

With reference now to FIG. 1, therein is seen a turbine blade which comprises a radially inward portion 1 including blade root 5 which is constituted of a metal material such as steel. Integrally formed with the radially inward portion 1 of the blade is a single-piece, radially outwardly extending contiguous supporting core 2 having a mushroom head 4. The mushroom head 4 of the supporting core 2 provides end support for a ceramic airfoil portion 3 which encircles core 2. The airfoil portion 3 has a radially inward end which abuts against the portion 1 and the outer surface of the airfoil portion 3 forms a continuous surface contour with portion 1. The ceramic airfoil portion 3 has a radial length which is not greater than one-half the span h of the glade and is preferably one-third the span h of the blade.

Figure 2:
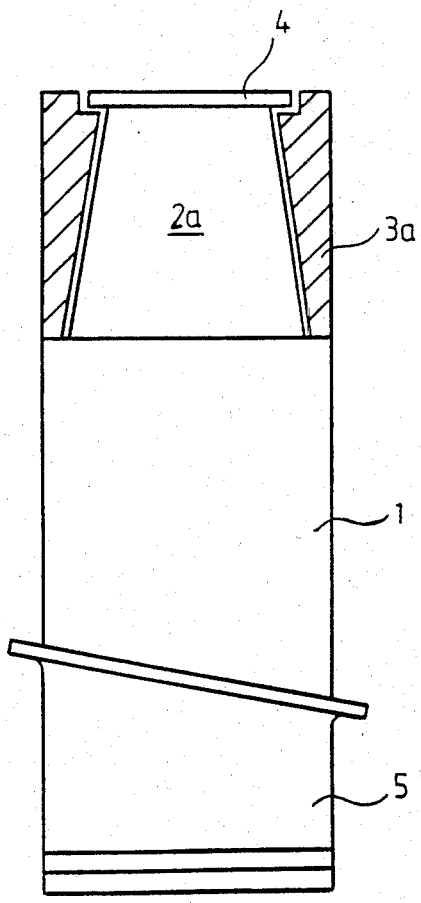
FIG. 2 is a similar view of another embodiment.

The blade illustrated in FIG. 2 is essentially of the same construction as that in FIG, 1, except that the wall thickness of the ceramic airfoil portion **3*a* increases in a radially outward direction towards the end of the blade. This enables the supporting core 2*a* of the blade to be tapered in a radially outward direction as illustrated in FIG. 2. In an alternative arrangement (not shown) a gap narrowing in a radially outward direction can be provided between the ceramic airfoil 3*a* and a constant-section supporting core. The arrangement illustrated in FIG. 2** is of particular advantage when the blade surface is subject to aggravated erosive wear as in the case of pulverized-coal engines. Aggravated erosion will wear away material especially in the radially outward region of the ceramic airfoil surface.

The added thickness of wall section in this region will provide a sufficient amount of material over an extended service period.

As seen from the above, the invention provides for a reduced length of ceramic airfoil portion in relation to the blade span i.e. preferably one-third thereof and this has the effect of substantially reducing the centrifugal forces on the ceramic material and thereby reducing the risk of cracking and subsequent fracture. Moreover, the ceramic airfoil portion is placed in the region where the particulate matter in the gas stream is found so as to confer high resistance to corrosion for the turbine blade. Thus, the ceramic material is judicially placed in the most effective location without detriment to the overall capability of the turbine blade. In the radially inward portion of the blade where there is less particulate matter and the centrifugal forces are less, the metal portion 1 is satisfactory.

Although the invention has been described in conjunction with specific embodiments thereof, it will become apparent to those skilled in the art that numerous modifications and variations can be made within the scope and spirit of the invention as defined by the attached claims.

What is claimed is:

1. A turbine blade adapted for use with hot gases comprising a radially inward portion constituted of metal, a metal core projecting radially from said inward portion, and a ceramic portion of airfoil section supported on said core and totally enclosing the same to form the entire airfoil section of the blade radially outwards of said metal inward portion, said ceramic portion extending radially less than one-half of the total span of the blade, said ceramic portion having a radially inward end of airfoil section adjacent said metal inward portion, said metal inward portion having an airfoil section which is continuous with that of said ceramic portion whereby the airfoil section of said blade is collectively composed by the metal inward portion and the outer ceramic portion.

2. A turbine blade as claimed in claim 1 wherein said core is integral with said inward portion.

3. A turbine blade as claimed in claim 1 wherein said ceramic portion extends radially about one-third of the blade span.

4. A turbine blade as claimed in claim 1, or 3 wherein said core includes a head at its radially outer end of mushroom shape to provide end support for said ceramic portion.

5. A turbine blade as claimed 1, 2, or 3 wherein said ceramic portion has a wall thickness which increases in a radially outwards direction.

* * * * *